United States Patent [19]

Allen

[11] 4,343,465

[45] Aug. 10, 1982

[54] SPRING TYPE ARM WRESTLING DEVICE

[76] Inventor: Dan V. Allen, Rolfe, Iowa 50581

[21] Appl. No.: 173,040

[22] Filed: Jul. 28, 1980

[51] Int. Cl.[3] ..... A63B 21/00

[52] U.S. Cl. ..... 272/67; 272/140; 272/DIG. 4; 272/DIG. 5; 73/381

[58] Field of Search ..... 272/67, 68, 93, 140, 272/143, DIG. 4; 73/379, 380, 381

[56] References Cited

U.S. PATENT DOCUMENTS

| | | | |
|---|---|---|---|
| 3,953,026 | 4/1976 | Stokely | 272/140 |
| 3,982,757 | 9/1976 | McDonnell | 272/67 X |
| 4,203,591 | 5/1980 | Gibson | 272/67 |

*Primary Examiner*—Richard C. Pinkham
*Assistant Examiner*—William R. Browne
*Attorney, Agent, or Firm*—Zarley, McKee, Thomte, Voorhees & Sease

[57] ABSTRACT

The arm wrestling device of the present invention utilizes a torsional spring attached to conventional collars with a shaft running through and extending beyond the length of the spring. The shaft is mounted in pivotal supports which allow the shaft to rotate counterclockwise when force is applied to an attached level arm. The clockwise rotation of the shaft is limited by an arm stop so that the lever arm does not pass a vertical position. A pointer connected to the opposite end of the shaft from the lever arm reads on a calibrated scale the units of torque developed in the spring when the force is applied to the arm. This arm wrestling device is for use by one person and simulates arm wrestling between two people.

7 Claims, 4 Drawing Figures

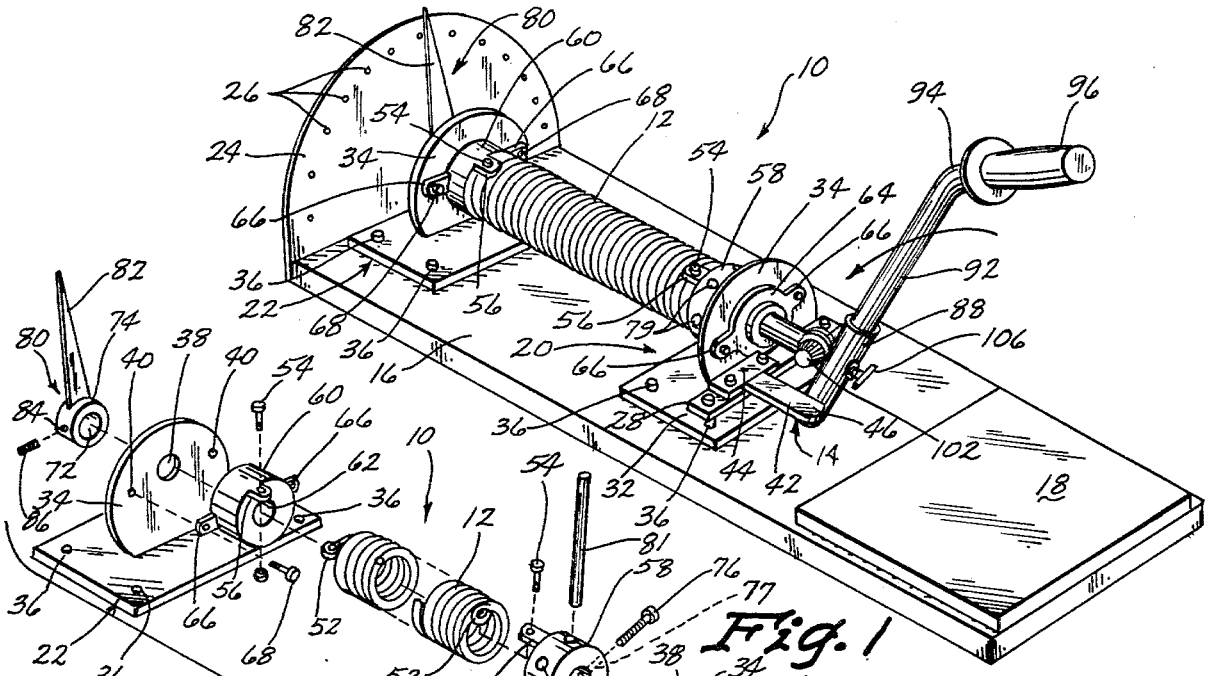
Fig. 1
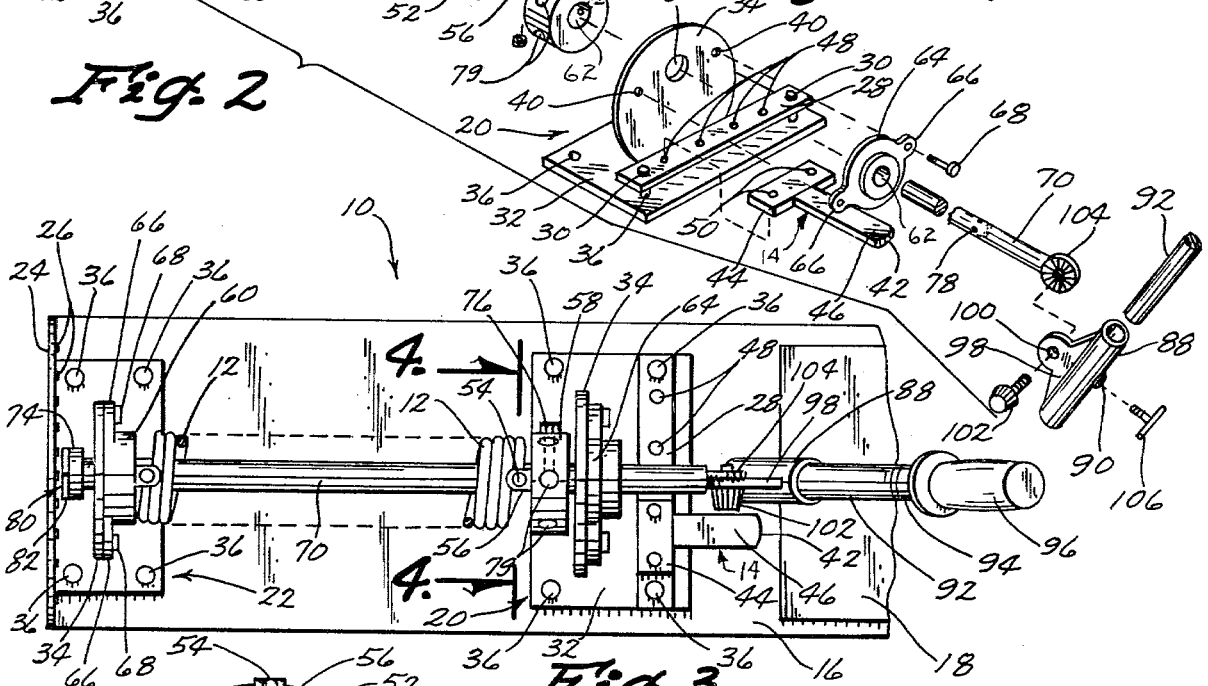
Fig. 2
Fig. 3
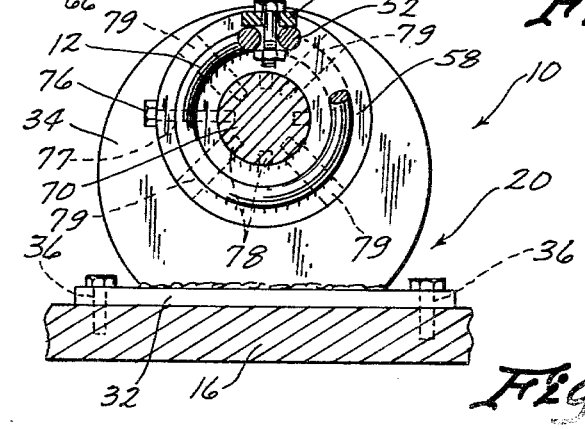
Fig. 4

SPRING TYPE ARM WRESTLING DEVICE

BACKGROUND OF THE INVENTION

In recent years arm wrestling has developed into a nationwide competitive sport. The sanctioned tournaments are taken seriously by a majority of the competitors, and training is essential in order to develop the needed skills and strength.

One important aspect of training is the practicing of arm wrestling. One major problem in practicing is finding a partner who is physically compatible with the person needing and desiring the practice. The length of the forearm is critical for developing technique. Also, in competition, a person is likely to face challengers who are physically taller or shorter, with different length forearms which require a slightly different technique if one is to be a victor. Therefore, various practice partners are needed, each with physically longer or shorter forearms. Therefore, a practicing and training device is needed to help wrestlers simulate conditions which occur in actual composition.

The arm wrestling device of the present invention provides a practice means for an individual which simulates actual arm wrestling, including various lengths of forearms.

Therefore, a primary object of this arm wrestling device is to provide a device for training an arm wrestler.

A further object of the present invention is to provide a form of recreation for the non-serious arm wrestler.

A further objective of the present invention is to provide an arm which is adjustable to various physical dimensions desired by the operator.

A further objective of the present invention is to provide an arm wrestling device for use by either left or right handed people.

A further objective of the present invention is to provide a means of adjusting the amount of force required to operate the arm wrestling device.

A further objective of the present invention is to provide a measure of the units of torque developed in the spring by the operator.

A further objective of the present invention is the provision of a device which is economical to manufacture, durable in use and efficient in operation.

SUMMARY OF THE INVENTION

The present invention utilizes a torsion spring fixed at one end and attached at the other end with conventional collars to a rotatable shaft. The shaft is mounted in a support which permits it to rotate about its longitudinal axis. The shaft has a lower arm connected to it at one end. At the opposite end of the shaft a pointer is attached which allows the operator to read from a calibrated scale the amount of force he is applying to the lever arm. The force required to move the lever arm increases as the angular displacement of the lever arm increases.

The spring can be placed on the shaft so as to have a counterclockwise or clockwise direction of torque for use by a right or left handed person, respectively. An arm stop holds the lever arm in its normal upright position.

The amount of force needed to displace the lever arm is adjustable by means of tightening the spring with respect to the at rest position of the shaft and lever arm.

There is an elbow pad which cushions the elbow of the operator while at the same time preventing the elbow from slipping or sliding.

BRIEF DESCRIPTION OF THE DRAWINGS

FIG. 1 is a perspective view of the arm wrestling device.

FIG. 2 is an exploded perspective view, showing how the device is assembled.

FIG. 3 is a plan view of the device showing the common vertical plane of the longitudinal axis of the base, the shaft, the spring, the pivotal supports, the collars, and the lever arm.

FIG. 4 is a sectional view taken along line 4—4 of FIG. 3 showing the common longitudinal axis of the shaft, the spring, and the collars.

DETAILED DESCRIPTION OF THE DRAWINGS

Referring to the drawings, the numeral 10 generally designates the arm wrestling device. An arm stop 14 comprises a horizontal plate 28 and a T-shaped plate 42.

The base 16 has attached to it an elbow pad 18, a first pivotal support 20, a second pivotal support 22, and a calibrated scale 24. The calibrated scale 24 is marked with calibrations 26 measuring units of force.

The first and second pivotal supports 20 and 22, respectively, have a horizontal plate 32 and a vertical truncated spherical plate 34. Each horizontal plate 32 has holes 36 for mounting the plate to base 16. Each vertical plate has a shaft guide hole 38 and two collar mount holes 40. The forwardmost holes 36 of the first pivotal support 20 correspond with holes 30 of the arm stop 14 for attaching the arm stop 14 to the pivotal support 20.

Horizontal plate 28 includes mounting holes 30 and T-shaped plate 42 includes a head 44 and a base 46. The horizontal plate 28 has four additional holes 48 which correspond to holes 50 in the head 44 for attaching T-shaped plate 42 to horizontal plate 28. The T-shaped plate 42 can be positioned in either the two left or the two right set of holes 48 for a right or left handed operator, respectively.

Spring 12 has an eye 52 at each end that permits fastening by a bolt 54 to a pair of collar spriing flanges 56 on a first collar 58 and a second collar 60, respectively. First and second collar 58 and 60, respectively, each have a shaft guide hole 62 sufficiently large to surround and permit a shaft 70 to rotate. A third collar 64 is also fitted over shaft 70. Second and third collars 60 and 64, respectively, each have two flanges 66 with a hole to permit the second and third collar 60 and 64, respectively, to be secured by bolts 68 to the forward side of the second and first pivot supports, 22 and 20, respectively.

A shaft 70 is rotatably journaled in plates 34 and has an axis coinciding with that of the following parts as it passes from forward to rearward ends of the arm wrestling device 10: shaft guide holes 62 in first, second and third collars 58, 60 and 64, respectively; shaft guide holes 38 of the vertical plates 34; spring 12; and a shaft guide hole 72 of a pointer ring 74. Shaft 70 is permitted to rotate in all of the above except the first collar 58 in which a pin 76 fits through a hole 77 in the first collar 58 into one of a plurality of circumferential holes 78 in shaft 70 to secure first collar 58 to shaft 70. These holes 78 allow the first collar 58 to be adjusted via pin 76 with respect to shaft 70 to increase or decrease the at-rest torsional force in spring 12. First collar 58 has a series of circumferential holes 79 which a lever 81 engages in order to aid when adjusting the first collar 58 so as to increase the torsional force in spring 12.

A pointer assembly 80 comprises a pointer ring 74 and a needle 82 which is integrally connected to pointer ring 74. Pointer ring has a hole 84 through its thickness which permits a set screw 86 to securely fasten pointer 80 to the rearward end of shaft 70.

At the forward end of shaft 70 is operatively secured to a sleeve 88 radially projecting from shaft 70. Sleeve 88 has a flange 98 with a hole 100 which permits a screw 102 to operatively secure sleeve 88 to shaft flange 104. On the side of the sleeve 88 opposite the flange 98 is a hole 90 which permits a thumb screw 106 to operatively secure lever arm 92 at various heights. Lever arm 92 projects radially upward and outward from shaft 70. At the upper end of lever arm 92 is a handle 94 projecting upwardly and outwardly from lever arm 92. Covering the handle 94 is a fraction grip 96 which gives the operator better control of the arm wrestling device 10.

The lever arm is initially in a position above the base so that the handle is above the elbow pad. The arm stop prevents the lever arm from rotating past this initial position which is urged by the spring.

When the lever arm is angularly displaced by the operator, the shaft and first collar 58 rotate accordingly. The forward end of the spring is connected to the first collar 58 while the rearward spring end is attached to the second collar 60 which does not rotate. Therefore, when the first collar rotates in response to the displacement of the lever arm, the torsional tension increases in the spring. The pointer assembly 80 is attached to the shaft and also rotates accordingly as the lever arm is displaced, thus allowing the operator to read from the calibrated scale the amount of force applied to the lever arm.

For a right handed person to operate the arm wrestling device, the arm stop is first placed in the two left holes 30 of the horizontal plate 28. The handle is adjusted to the desired height by loosening thumb screw 106 and moving the lower arm within tube 88 to the desired position, then tightening the thumb screw. The angle of the lever arm and handle may also be adjusted by loosening screw 102. The spring is then mounted on the shaft so that the spring urges the lever arm to rotate in a clockwise position. The torsional forces in the spring is adjusted to the desired level placing pin 76 through first collar 58, hole 77 and the appropriate circumferential shaft hole 78.

The operator then grasps the handle and displaces it in a counterclockwise direction, thus simulating actual arm wrestling. While the lever is displaced, the amount of force exerted by the operator may be read off the calibrated scale.

For a left handed person to operate the device, the spring ends are reversed and the arm stop is placed in the two holes 30 on the right side of the horizontal plate 28.

Thus, it can be seen that the device accomplishes at least all of its stated objectives.

What is claimed is:

1. An arm wrestling device for use in training for arm wrestling competition or for recreation, comprising:

a base support, having an upper surface and a pair of spaced apart shaft supports on said upper surface;

an elbow support on said upper surface adjacent one of said shaft supports;

an elongated shaft extending between and rotatably journaled within said shaft supports, said shaft having first and second opposite ends;

a lever arm operatively connected to said first end of said shaft and extending radially outwardly therefrom to terminate in a handle, said handle being located above said elbow support;

said lever arm and said shaft being pivotal about the longitudinal axis of said shaft from a first position wherein said handle is above said base to a second position wherein said handle is lowered to approximately the level of said base;

spring means interconnecting said shaft and said shaft supports for yieldably urging said lever arm and said shaft from said second to said first positions;

stop means engaging said lever arm for limiting the rotation of said lever arm beyond said first position in response to said spring means;

a pointer assembly operatively connected to said second end of said shaft;

a calibrated scale mounted on said base support adjacent said pointer assembly;

said spaced apart shaft supports each comprising a rectangular horizontal plate and an integrally connected truncated circular vertical plate, each of said horizontal plates having holes for connecting said horizontal plates to said base support, said horizontal plate of one of said shaft supports having additional holes for operatively attaching said stop means, each of said vertical plates having a hole therethrough with a diameter sufficiently large to rotatably receive said first and second ends of said shaft respectively.

2. A device according to claim 1 wherein said pointer assembly comprises a tube portion and an integrally connected triangular needle; said tube portion having a securing means to operatively attach said pointer assembly to said second end of said shaft.

3. A device according to claim 1 wherein said scale is calibrated in such a manner so as to measure the units of torque developed in the spring when said lever arm is displaced by the operator of said arm wrestling device.

4. A device according to claim 1 wherein said lever arm is operatively attached to a sleeve; said sleeve having securing means for being operatively connected to said shaft.

5. A device according to claim 1 wherein said stop means is reversible to hold said shaft against rotation in a direction from said first position towards said second position and to permit said shaft to rotate in a second direction from said first position to a third position, said spring means being reversible to cause yieldable urging of said shaft from said third position toward said first position.

6. An arm wrestling device for use in training for arm wrestling competition or for recreation, comprising:

a base support, having an upper surface and a pair of spaced apart shaft supports on said upper surface;

an elbow support on said upper surface adjacent one of said shaft supports;

an elongated shaft extending between and rotatably journaled within said shaft supports, said shaft having first and second opposite ends;

a lever arm operatively connected to said first end of said shaft and extending radially outwardly therefrom to terminate in a handle, said handle being located above said elbow support;

said lever arm and said shaft being pivotal about the longitudinal axis of said shaft from a first position wherein said handle is above said base to a second position wherein said handle is lowered to approximately the level of said base;

spring means interconnecting said shaft and said shaft supports for yieldably urging said lever arm and said shaft from said second to said first positions;

stop means engaging said lever arm for limiting the rotation of said lever arm beyond said first position in response to said spring means;

a pointer assembly operatively connected to said second end of said shaft;

a calibrated scale mounted on said base support adjacent said pointer assembly;

said spring means comprising an elongated cylindrical coil having a first collar attached to one end thereof and a second collar attached to the opposite end thereof; said spring and said collars surrounding said shaft between said first and second supports;

said second collar being operatively affixed to one of said shaft supports, said shaft having a series of circumferential holes therein, a pin carried on said first collar and being inserted into one of said circumferential holes, said pin being selectively removable therefrom for insertion into another of said holes for permitting adjustment of the relative rotational positions of said shaft and said first collar and hence adjustment of the tortional force in said spring.

7. An arm wrestling device for use in training for arm wrestling competition or for recreation, comprising:

a base support, having an upper surface and a pair of space apart shaft supports on said upper surface;

an elbow support on said upper surface adjacent one of said shaft supports;

an elongated shaft extending between and rotatably journaled within said shaft supports, said shaft having first and second opposite ends;

a lever arm operatively connected to said first end of said shaft and extending radially outwardly therefrom to terminate in a handle, said handle being located above said elbow support;

said lever arm and said shaft being pivotal about the longitudinal axis of said shaft from a first position wherein said handle is above said base to a second position wherein said handle is lowered to approximately the level of said base;

spring means interconnecting said shaft and said shaft supports for yieldably urging said lever arm and said shaft from said second to said first positions;

stop means engaging said lever arm for limiting the rotation of said lever arm beyond said first position in response to said spring means;

a pointer assembly operatively connected to said second end of said shaft;

a calibrated scale mounted on said base support adjacent said pointer assembly;

said stop means comprising a rectangular plate and a T-shaped plate, first securing means operatively securing said rectangular plate to one of said shaft supports;

additional securing means operatively attaching said rectangular plate to said T-shaped plate.

* * * * *